United States Patent [19]

Szeremeta

[11] Patent Number: 4,761,200

[45] Date of Patent: Aug. 2, 1988

[54] APPARATUS FOR APPLYING A FLEXIBLE PLASTIC LABEL TO A ROUND CONTAINER

[75] Inventor: Walter Szeremeta, Waterville, Ohio

[73] Assignee: Owens-Illinois Plastic Products Inc., Toledo, Ohio

[21] Appl. No.: 16,824

[22] Filed: Feb. 20, 1987

[51] Int. Cl.[4] ..... B05C 1/02; B65C 9/04; B65C 9/22

[52] U.S. Cl. ..... 156/448; 118/231; 118/259; 156/449; 156/568; 156/578; 156/DIG. 26; 156/DIG. 35

[58] Field of Search ..... 156/578, 568, DIG. 35, 156/447, 448, 449, DIG. 26; 118/231, 244, 259

[56] References Cited

U.S. PATENT DOCUMENTS

| | | | |
|---|---|---|---|
| 3,134,326 | 5/1964 | Davis | 118/259 |
| 3,793,983 | 2/1974 | Shelestak | 118/244 |
| 4,347,095 | 8/1982 | Yamashita | 156/578 |
| 4,369,214 | 1/1983 | Pfülb et al. | 156/568 |
| 4,574,020 | 3/1986 | Fosnaught | 156/578 |
| 4,693,210 | 9/1987 | DiFrank | 118/231 |

*Primary Examiner*—Michael Wityshyn

[57] ABSTRACT

In the application of a solvent to a plastic label carried on the surface of a vacuum drum, the solvent for the plastic label is transferred from a gravure roll to the label at finite areas on the label so that the label can adhere to the bottle to be labeled and to itself to form a complete sleeve label. The gravure roll is supplied from a fountain block with a part cylindrical face that engages the gravure roll in face to face contact. The fountain block is retained in a holder with spaced adjustment devices for adjusting the position of the fountain block in the holder.

The fountain block holder is held by a vertical support plate that, in turn, is held to the surface of a vertical mounting plate by inverted L-shaped edge retainers that engage the leading edge of the support plate, the trailing edge of the support plate being contacted by a manually operable threaded fastener that maintains the leading edge of the support plate in engagement with the edge retainers when the threaded fastener is in a predetermined position. The threaded fastener is threadably movable within an internally threaded block that is attached to the support plate between the predetermined position and another position in which the support plate may be quickly disengaged from the mounting plate. The fountain block holder is pivotally attached to a pair of spaced apart flanges that extend normally from the support plate.

7 Claims, 2 Drawing Sheets

APPARATUS FOR APPLYING A FLEXIBLE PLASTIC LABEL TO A ROUND CONTAINER

BACKGROUND OF THE INVENTION

1. Field Of The Invention

This invention relates to equipment for applying double-ended flexible plastic labels to round containers, such as bottles and cans, on a high-speed production basis.

2. Description Of The Prior Art

U.S. Pat. No. 4,323,416 (Malthouse et al.) discloses equipment for applying double-ended labels from a web or strip of such labels to bottles. Thus equipment is provided with an adhesive applicator to apply an adhesive substance to the label, after the label has been severed from the web or strip and before the label is applied to the bottle, to ensure adhesion of the label to the bottle. Adhesive usually used in bottle labeling equipment of this type is a hot-melt adhesive, and the use of such a hot-melt adhesive is messy and can be expensive because of the cost of the adhesive and the cost of equipment for storing it, handling it, and applying it. Further, the use of a hot-melt adhesive system leads to a high temperature environment near the labeling machine which is uncomfortable for the operator and which requires special safety precautions for the proper operation and servicing of the machine. U.S. Pat. No. 4,406,721 (Hoffman) also discloses a system for applying double-ended labels from a web of such labels to bottles or other containers. The system of Hoffman utilizes heat to cause the labels to shrink after they have been applied to the bottles. U.S. Pat. No. 3,235,433 (Cvacho, et al.) describes a similar system in which a heat-activatable adhesive that is pre-applied to the label is heat activated before the label is applied to the container.

U.S. Pat. No. 4,574,020 (Fosnaught), which is assigned to the assignee of this application, the disclosure of which is hereby incorporated by reference herein, recognized the objection to the use of a hot-melt adhesive in a container labeling system, especially in regard to a container labeling system that utilizes labels formed from thermoplastic materials. The invention described in the aforesaid U.S. Pat. No. 4,574,020 eliminated the need for an applicator to apply a hot-melt adhesive to the label being applied to the bottle by utilizing a gravure roll applicator to apply an unheated solvent for the thermoplastic material in the label, such as methylene chloride as a solvent for labels formed from polystyrene, thereby eliminating some of the disadvantages inherent in utilizing a hot-melt adhesive in a bottle labeling system.

In the operation of the system disclosed in the aforesaid U.S. Pat. No. 4,574,020, one of the most critical aspects is the precise transfer of the solvent from the gravure roll to the surface of the label. If the gravure roll surface and the label surface do not make proper contact, there will not be sufficient solvent applied to the label in order to dissolve the desired portions of the label so as to make it adhere to the bottle or container as it comes into contact therewith and transfers thereto. Likewise, as the label trailing edge overlaps the leading edge, it is absolutely necessary that a full height strip of solvent be applied to the trailing edge so that a complete overlap seam will be formed. This seam must be complete since some subsequent heat shrinkage of the label about the bottle will open the seam up and produce a defective label if the seam is not sealed throughout its full height.

The label is carried by a rotatable vacuum drum which has sets of raised areas or pads on its periphery that underlie the leading and trailing edges of the label, and the rotating gravure roll is set to engage these raised critical portions of the label during the rotation of the vacuum drum and the gravure roll relative to one another. The gravure roll is normally mounted on a platform which is shiftable about a vertical axis that is parallel to the axis of the roll. In order to ensure that the solvent is properly applied, the gravure roll must carry a sufficient quantity of solvent on its surface pattern. The use of a vertical fountain biased against the gravure to apply solvent to the gravure roll is shown in the aforesaid U.S. Pat. No. 4,574,020. However, the fountain disclosed in this patent requires considerable down time in order to remove the fountain, and it frequently is necessary to remove a fountain to repair a jam up in the labeling machine or to change fountains as they become worn or become contaminated with extraneous materials.

SUMMARY OF THE INVENTION

According to the present invention there is provided apparatus for successively applying flexible thermoplastic labels to the cylindrical body portions of round containers, such as bottles or cans. The apparatus of this invention, which is otherwise similar to that disclosed in the aforesaid U.S. Pat. No. 4,574,020 of Harold R. Fosnaught, incorporates a fountain to apply a solvent to a cylindrical gravure roll, which fountain can be quickly and easily removed from the gravure roll, and can be quickly and easily re-installed, by means of a single, hand-operable threaded fastener, and which, further, is capable of swiveling with respect to the gravure roll to maintain optimum contact between the gravure roll and the fountain.

Accordingly, it is an object of the present invention to provide an improved apparatus for quickly and efficiently sequentially applying plastic labels to containers without using a hot-melt adhesive.

More particularly, it is an object of the present invention to provide an improved fountain apparatus for applying a solvent adhesive to a gravure roll for applying the solvent to preselected portions of a thermoplastic label for a container, which fountain apparatus may be quickly and easily removed from and reinstalled in relationship to the gravure roll, and is capable of swiveling with respect to the gravure roll to maintain optimum contact between the gravure roll and the fountain apparatus.

DETAILED DESCRIPTION OF THE PREFERRED EMBODIMENT

Figure 1:
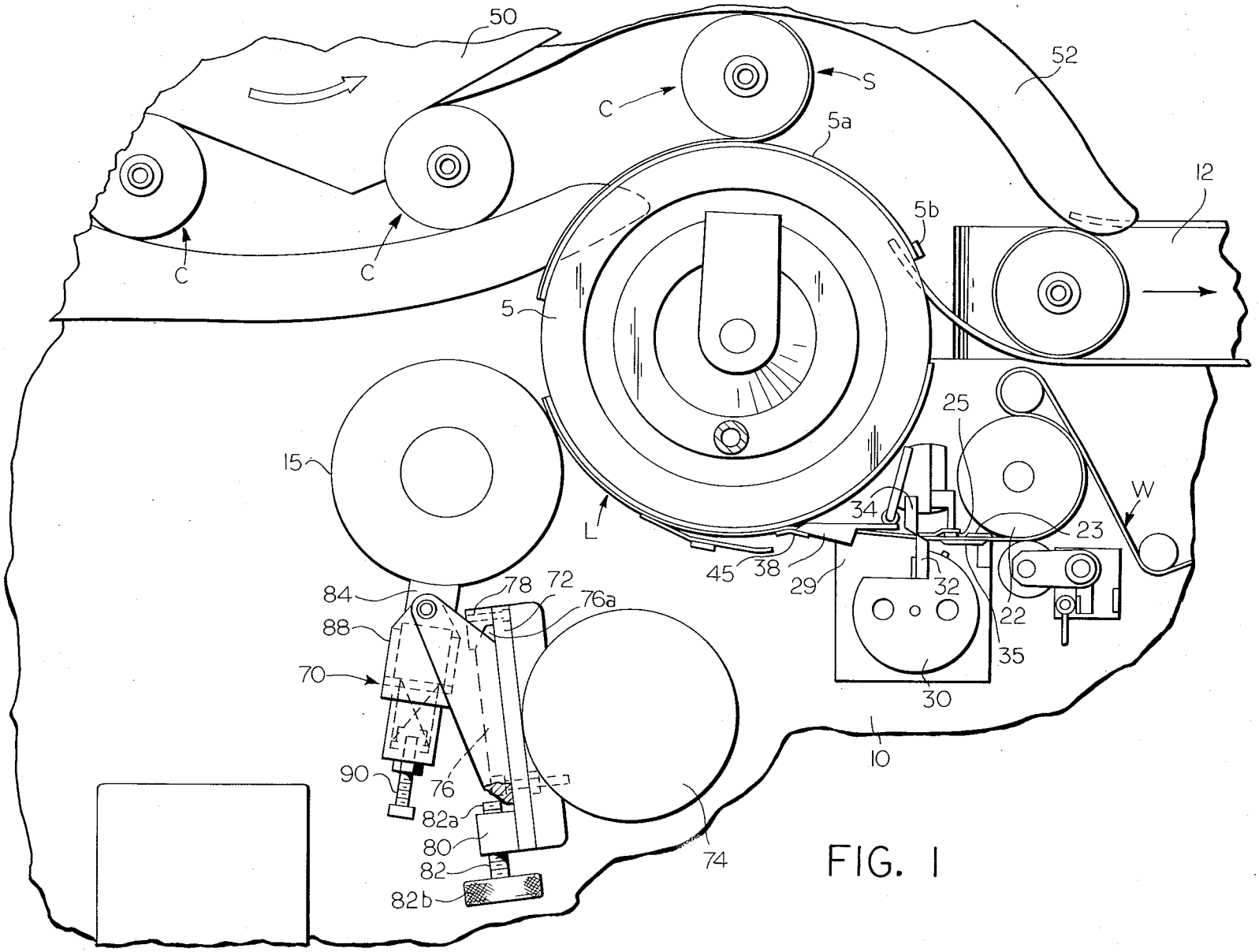
FIG. 1 is a fragmentary plan view showing the apparatus according to the present invention.
Figure 2:
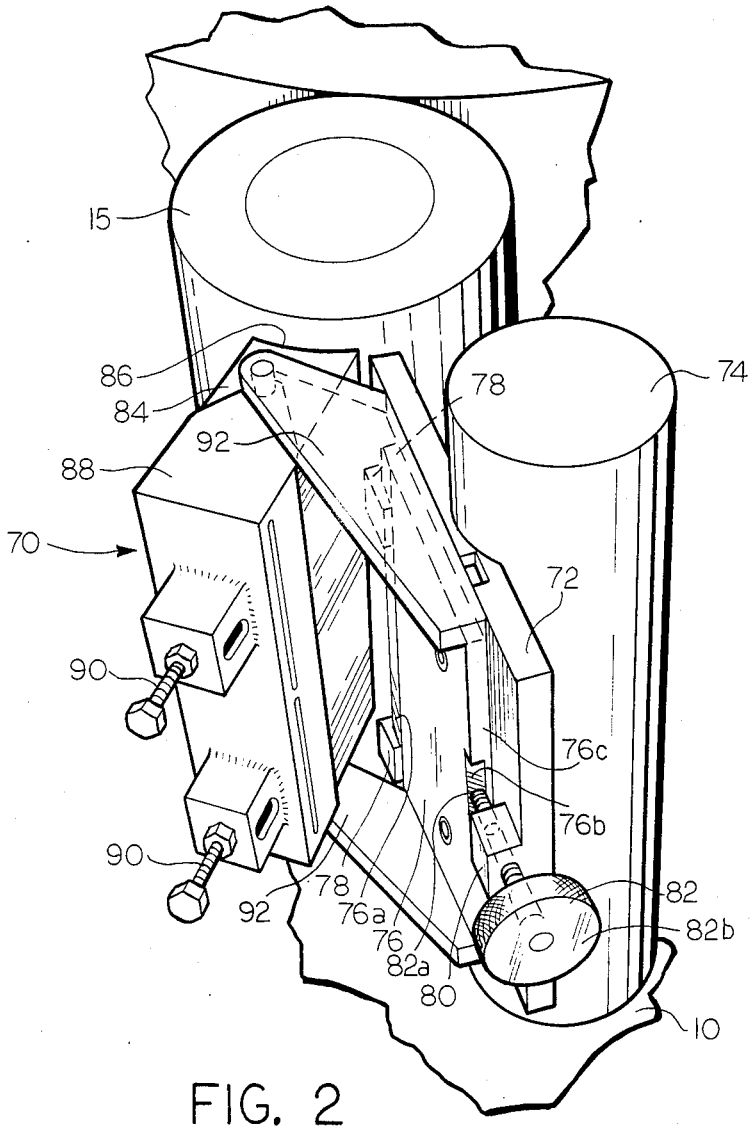
FIG. 2 is a fragmentary perspective view showing a portion of the apparatus of FIG. 1.

As is shown in FIG. 1, the apparatus according to the present invention incorporates a rotatable vacuum drum 5 which is supported by a horizontally extending supporting table 10, shown fragmentarily, that is supported above the shop floor on vertical legs, not shown. The vacuum drum 5 is rotatable about its vertical central axis with raised portions 5a having raised projections 5b thereon in nearly tangential relationship with a container C at a label-wrapping station S. A flexible plastic label L, such as a label formed from a polystyrene foam/film laminate or co-extrudate, is partly disposed about a portion of the periphery of the rotatable vacuum drum 5.

The plastic labels L are produced, in succession, from a web W of such labels L, the web W being formed from an unwinding roll, not shown, of the label material. The web W is gradually advanced toward the rotatable vacuum drum 5 by a driven feed roll 22 past a web guide 23 and a stationary directing bar 25 which is parallel to and adjacent to the outer periphery of a rotating member 30. The web W is guided by the action of the directing bar 25 and a primary feed guide 35 on the other side of the passing web. A secondary feed guide 38 guides the cut end of the web W towards the vacuum drum 5 and a final guide 45 guides the leading edge of the cut web W into contact with the vacuum drum 5. Individual labels L are formed from the web W at a severing station, indicated generally by reference numeral 29, by means of a knife 32 which is mounted on the periphery of a rotating member 30 and which severs the web W into a succession of labels L by virtue of the periodic engagement of the knife 32 with a fixed knife 34. The leading edge of the label L emerging from the severing station 29 is engaged by vacuum in the rotatable vacuum drum 5 which is applied to the label L through vacuum ports, not shown.

A gravure roll 15, which is rotatable about its vertical central axis, is provided to apply a solvent to predetermined leading and trailing edge portions of the label L as the label passes through the nip between the gravure roll 15 and the rotatable vacuum drum 5. Preferably, the gravure roll 15 and the vacuum drum 5 are each driven, and in synchronization, by conventional gear type or other driving mechanisms, not shown, to ensure that there is no slippage between the label L and either the rotatable vacuum drum 5 or the gravure roll 15 as the label L passes therebetween. The solvent is applied to the outside of the gravure roll 15 in a layer of carefully controlled and uniform thickness by a fountain assembly 70 which will be hereinafter described more fully.

As can be seen in FIG. 1, containers C are successively transferred to the label-wrapping station S by transfer equipment that includes a conveyor, not shown, and a star wheel 50, shown fragmentarily, which takes the containers C from the conveyor and presents them in a proper, spaced apart relationship along the radially interior side of a fixed arcuate surface 52, the movement of each container C along the fixed arcuate surface 52 resulting from rolling which causes each such container C to counterrotate with respect to the label L being applied thereto at the label-wrapping station S. By virtue of the solvent-softened, adhesive condition of the leading edge portion of the label L, it is picked up by a container C as such container C rolls along the inside of the fixed arcuate surface 52, the vacuum forces tending to hold the label L against the rotatable vacuum drum 5 being discontinued before the leading edge of the label L contacts the container C. Continuation of the rolling of the container C along the inside surface of the fixed arcuate surface 52 will, therefore, completely strip the label L off the rotatable vacuum drum 5 as the label L is progressively wound around the container C and the label L will be permanently adhered to the container C by virtue of the adhesion of the leading edge of the label L to the container C and the adhesion of the trailing edge of the label L to the container C or, in the case of a label whose length exceeds the circumference of the container C, to the overlapped leading edge of such label L.

As the container C, now carrying a label L applied thereto, exits from the fixed arcuate surface 52, it is picked up by the upper flight of an endless take-out conveyor 12 that moves the labeled containers in the direction of the arrow to a heating station to cause the label L to shrink into tight engagement with the container C, if such a shrinking step is desired, or to packing station or an inspection station, not shown, or, in the case of the labeling of empty containers C, to a filling line for filling and capping such containers.

The fountain assembly 70 of the present invention is mounted on a vertically extending plate 72 which, in turn, is attached to a support pedestal 74 that is attached to the supporting table 10, and the fountain assembly 70 includes a support plate 76 which is detachably mounted in face to face relationship with the plate 72. The plate 72 has a pair of spaced retainers 78 in the form of inverted L-shaped members attached thereto, and the support plate 76 has a leading edge 76a which is received in the retainers 78. Preferably, the leading edge 76a of the support place engages the retainers 78 in surface to surface contact, and even more particularly, as shown, the engaging surfaces of the leading edge 76a and the retainers 78 are tapered. The plate 72, further, has a raised boss 80 attached thereto, and the boss 80 is internally threaded to threadably receive a finger engageable threaded fastener 82. The threaded fastener 82 has a leading end 82a which engages a bevelled portion 76b of a trailing edge 76c of the support plate 76 to maintain the leading edge 76a of the support plate 76 in firm engagement within the spaced retainers 78, and, further, the threaded fastener 82 has a manually engageable enlarged head end 82b that is opposed to the leading end 82a. Of course, when the threaded fastener 82 is partly unscrewed from the boss 80, the leading end 82 will no longer engage the bevelled portion 76b of the support plate 76, which permits the support plate 76 to be swung away from the plate 72 and, thereby, permits the leading edge 76a of the support plate 76 to be withdrawn from the spaced retainers 78. This permits the quick disassembly of the fountain assembly 70 from the plate 72, and the quick reassembly of such fountain assembly or an alternative fountain assembly to the support plate 76.

The fountain assembly 70 further includes a hard plastic fountain block 84 which has a part-cylindrical contoured face 86 that bears against the gravure roll 15 to properly apply solvent thereto, solvent being applied to internal passages (not shown) within the fountain block 84 by suitable fluid connection lines (also not shown). For optimum contact between the fountain block 84 and the gravure roll 15, the fountain block 84 is adjustably mounted within a fountain block holder 88 that is an element of the fountain assembly 70, and spaced, threadable fountain block adjustment devices 90 are provided to adjust the position of the fountain block holder 84 within the fountain block 88. Further, the fountain block holder 88 is pivotally mounted with respect to the support plate 76 by pivotally attaching it to spaced flanges 92 that extend horizontally therefrom. Thus, the fountain assembly 70 provides for some swiveling action of the fountain block 84 with respect to the circumference of the gravure roll 15 for optimum contact therebetween.

Although the best mode contemplated by the inventor for carrying out the present invention as of the filing date hereof has been shown and described herein, it will be apparent to those skilled in the art that suitable modifications, variations, and equilvalents may be made without departing from the scope of the invention, such scope being limited solely by the terms of the following claims.

What is claimed is:

1. Apparatus for sequentially wrapping flexible thermoplastic labels around containers, each of said containers having one of each of said flexible thermoplastic labels wrapped therearound by said apparatus, each of said containers having a generally cylindrical body portion, each of said flexible thermoplastic labels being wrapped around the cylindrical body portion of one of said containers by said apparatus, said apparatus comprising:

a rotatable vacuum drum;

means for rotating said rotatable vacuum drum;

means for sequentially providing said labels to said rotatable vacuum drum to successively apply a leading edge of each of said labels against said rotating vacuum drum to be temporaily retained against said rotatable vacuum drum;

rotatable gravure roll means forming a nip with said rotatable vacuum drum for applying a solvent to predetermined portions of each of said flexible thermoplastic labels as said each of said flexible thermoplastic labels passes through said nip, said solvent forming an adhesive with said predetermined portions of said each of said flexible thermoplastic labels;

means for sequentially transferring said labels from said rotatable vacuum drum to said body portions of said containers at a wrapping station to effect sequential adhesion of said labels to said body portions of said containers;

means for mounting fountain assembly means for applying a solvent to said rotatable gravure roll, said means for mounting including plate means, edge retaining means operatively associated with said plate means, and threaded fastener engaging means operatively associated with said plate means and spaced apart from said edge retaining means, said threaded fastener engaging means including a threaded fastener that is threadably movable between a first position that is away from said edge retaining means and a second position that is closer to said edge retaining means than said first position; and fountain assembly means for applying a solvent to said rotatable gravure roll means, said fountain assembly means comprising:

a support plate having a first edge and a second edge, said first edge of said support plate being received within said edge retaining means, said second edge being engaged by said threaded fastener when said threaded fastener is in said second position to maintain said first edge of said support plate in engagement with said edge retaining means, said second edge not being engaged by said threaded fastener when said threaded fastener is in said first position, whereby said first edge can be withdrawn from said edge retaining means and said fountain assembly can be removed from said means for mounting when said threaded fastener is in said first position;

a solvent applying fountain operatively attached to said support plate, said solvent applying fountain including a fountain block with a part cylindrical face that is maintained in solvent applying, surface-to-surface engagement with said rotatable gravure roll means when said first edge of said support plate is received within said edge retaining means;

a fountain block holder, a part of said fountain block that is away from said part cylindrical face being received in said fountain block holder;

spaced fountain block adjustment devices for adjusting the position of said fountain block within said fountain block holder; and means for pivotally mounting said fountain block holder with respect to said support plate.

2. Apparatus according to claim 1 wherein said fountain block holder comprises a first end and a second end and wherein said means for pivotally mounting comprises first and second flange means extending normally from said support plate, said first and second flange means being spaced apart, one of said first and second flange means pivotally receiving said first end of said fountain block holder, the other of said first and second flange means pivotally receiving said second end of said fountain block holder.

3. Apparatus according to claim 1 wherein said second edge of said support plate has a bevelled portion, said bevelled portion being engaged by said threaded fastener when said threaded fastener is in said second position.

4. Apparatus according to claim 1 wherein said first edge of said support plate comprises at least one tapered portion, said at least one tapered portion being received in said edge retaining means, said edge retaining means comprising a tapered surface that engages said at least one tapered portion of said first edge of said support plate in surface to surface contact when said threaded fastener is in said second position.

5. Apparatus according to claim 1 wherein said edge retaining means comprises first and second spaced apart edge retainers, and wherein said first edge of said support plate comprises first and second spaced apart tapered portions, said first tapered portion being received in said first edge retainer and said second tapered portion being received in said second edge retainer when said threaded fastener is in said second position.

6. Apparatus according to claim 5 wherein said first edge retainer comprises a tapered surface and wherein said second edge retainer comprises a tapered surface, said tapered surface of said first edge retainer engaging said first tapered portion of said first edge of said support plate in surface to surface contact and said tapered surface of said second edge retainer engaging said second tapered portion of said first edge of said support plate when said threaded fastener is in said second position.

7. Apparatus according to claim 1 wherein said threaded fastener comprises an enlarged, manually engageable head end.

* * * * *